US010177476B1

(12) United States Patent
Phillips et al.

(10) Patent No.: US 10,177,476 B1
(45) Date of Patent: Jan. 8, 2019

(54) CARD EDGE CONNECTOR ASSEMBLY

(71) Applicant: TE CONNECTIVITY CORPORATION, Berwyn, PA (US)

(72) Inventors: Michael John Phillips, Camp Hill, PA (US); Kevin Edward Weidner, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/726,459

(22) Filed: Oct. 6, 2017

(51) Int. Cl.

| | |
|---|---|
| ***H01R 13/62*** | (2006.01) |
| ***H01R 12/72*** | (2011.01) |
| ***H01R 12/70*** | (2011.01) |
| ***H01R 13/64*** | (2006.01) |
| ***H01R 12/79*** | (2011.01) |
| ***H01R 12/52*** | (2011.01) |
| ***H01R 13/629*** | (2006.01) |
| *H01R 12/73* | (2011.01) |

(52) U.S. Cl.
CPC ..... *H01R 12/721* (2013.01); *H01R 12/52* (2013.01); *H01R 12/7005* (2013.01); *H01R 12/732* (2013.01); *H01R 12/79* (2013.01); *H01R 13/629* (2013.01); *H01R 13/64* (2013.01); *H01R 12/737* (2013.01)

(58) Field of Classification Search
CPC ..... H01R 12/77; H01R 12/79
USPC ..... 439/329, 328, 325
See application file for complete search history.

(56) References Cited

U.S. PATENT DOCUMENTS

| | | | | |
|---|---|---|---|---|
| 6,056,579 | A * | 5/2000 | Richards, III | H05K 7/1454 439/327 |
| 6,585,534 | B2 * | 7/2003 | Llapitan | H01L 23/4093 257/E23.086 |
| 7,641,495 | B1 * | 1/2010 | Sun | H05K 3/366 439/327 |
| 2013/0089997 | A1 * | 4/2013 | Orris | H01R 12/592 439/329 |

* cited by examiner

*Primary Examiner* — Phuong Dinh

(57) ABSTRACT

A card edge connector assembly includes a pluggable module having a paddle card with a card edge and a card edge connector having a housing defining a card slot receiving the card edge. The housing holds contacts in the card slot to electrically connect to corresponding contact pads of the paddle card. Support hardware is coupled to the pluggable module and includes first and second mounting legs. The first mounting leg has a first mounting foot and the second mounting leg has a second mounting foot configured to be mounted to the host circuit board to support the pluggable module on the host circuit board independent of the card edge connector.

18 Claims, 3 Drawing Sheets

CARD EDGE CONNECTOR ASSEMBLY

BACKGROUND OF THE INVENTION

The subject matter herein relates generally to card edge connector assemblies.

Card edge connectors are used in various system applications. For example, card edge connectors are typically mounted to a host circuit board. The card edge connectors include card slots for receiving a card edge of a pluggable module. The pluggable module includes a card having electrical components thereon forming electrical circuits.

However, known card edge connectors are not without disadvantages. For instance, the card edge connectors are used for supporting the pluggable modules. The card edge connectors may be subjected to stresses and strains during mating or when mated with the pluggable module, which may damage or break the soldered connections between the contacts of the card edge connector and the host circuit board.

A need remains for a card edge connector assembly that may be mated with pluggable modules in a reliable manner.

BRIEF DESCRIPTION OF THE INVENTION

In one embodiment, a card edge connector assembly is provided including a pluggable module having a paddle card at a mating end of the pluggable module having a card edge including contact pads. The pluggable module has a first side and a second side extending between a first end and a second end. The card edge connector assembly includes a card edge connector having a housing defining a card slot receiving the card edge of the paddle card. The housing has a base configured to be mounted to a host circuit board. The housing holds contacts in the card slot to electrically connect to corresponding contact pads of the paddle card. The contacts are configured to be electrically connected to the host circuit board. The housing has a first side and a second side extending between a first end and a second end. Support hardware is coupled to the pluggable module. The support hardware has a first mounting leg extending from the first end of the pluggable module and a second mounting leg extending from the second end of the pluggable module. The first mounting leg has a first mounting foot configured to be mounted to the host circuit board and the second mounting leg has a second mounting foot configured to be mounted to the host circuit board to support the pluggable module on the host circuit board independent of the card edge connector.

In another embodiment, a card edge connector assembly is provided including a pluggable module having a paddle card at a mating end of the pluggable module having a card edge including contact pads. The pluggable module has a first side and a second side extending between a first end and a second end. The card edge connector assembly includes a card edge connector having a housing defining a card slot receiving the card edge of the paddle card. The housing has a base configured to be mounted to a host circuit board. The housing holds contacts in the card slot to electrically connect to corresponding contact pads of the paddle card. The contacts are configured to be electrically connected to the host circuit board. The housing has a first side and a second side extending between a first end and a second end. Support hardware is coupled to the pluggable module. The support hardware has a first mounting leg extending from the first end of the pluggable module and a second mounting leg extending from the second end of the pluggable module. The first mounting leg has a first latch at a distal end of the first mounting leg configured to be latchably secured to the host circuit board and the second mounting leg has a second latch at a distal end of the second mounting leg configured to be latchably secured to the host circuit board to latchably secure the pluggable module to the host circuit board independent of the card edge connector. The support hardware has an actuator to release at least one of the first latch and the second latch to release the support hardware from the host circuit board to remove the pluggable module from the card edge connector.

In a further embodiment, a card edge connector assembly is provided including a host circuit board having a mounting area having a plurality of contact pads, a first slot proximate to the mounting area and a second slot proximate to the mounting area. The card edge connector assembly includes a card edge connector having a housing defining a card slot and having a base mounted to the mounting area of the host circuit board. The housing holds contacts in the card slot electrically connected to corresponding contact pads on the host circuit board. The card edge connector assembly includes a pluggable module having a paddle card at a mating end of the pluggable module having a card edge including contact pads. The paddle card is received in the card slot to electrically connect the contact pads of the paddle card to the contacts of the card edge connector. The pluggable module has a first side and a second side extending between a first end and a second end. Support hardware is coupled to the pluggable module. The support hardware has a first mounting leg extending from the first end of the pluggable module and a second mounting leg extending from the second end of the pluggable module. The first mounting leg has a first mounting foot received in the first slot and the second mounting leg has a second mounting foot received in the second slot. The support hardware is mounted to the host circuit board to support the pluggable module on the host circuit board independent of the card edge connector.

DETAILED DESCRIPTION OF THE INVENTION

Figure 1:
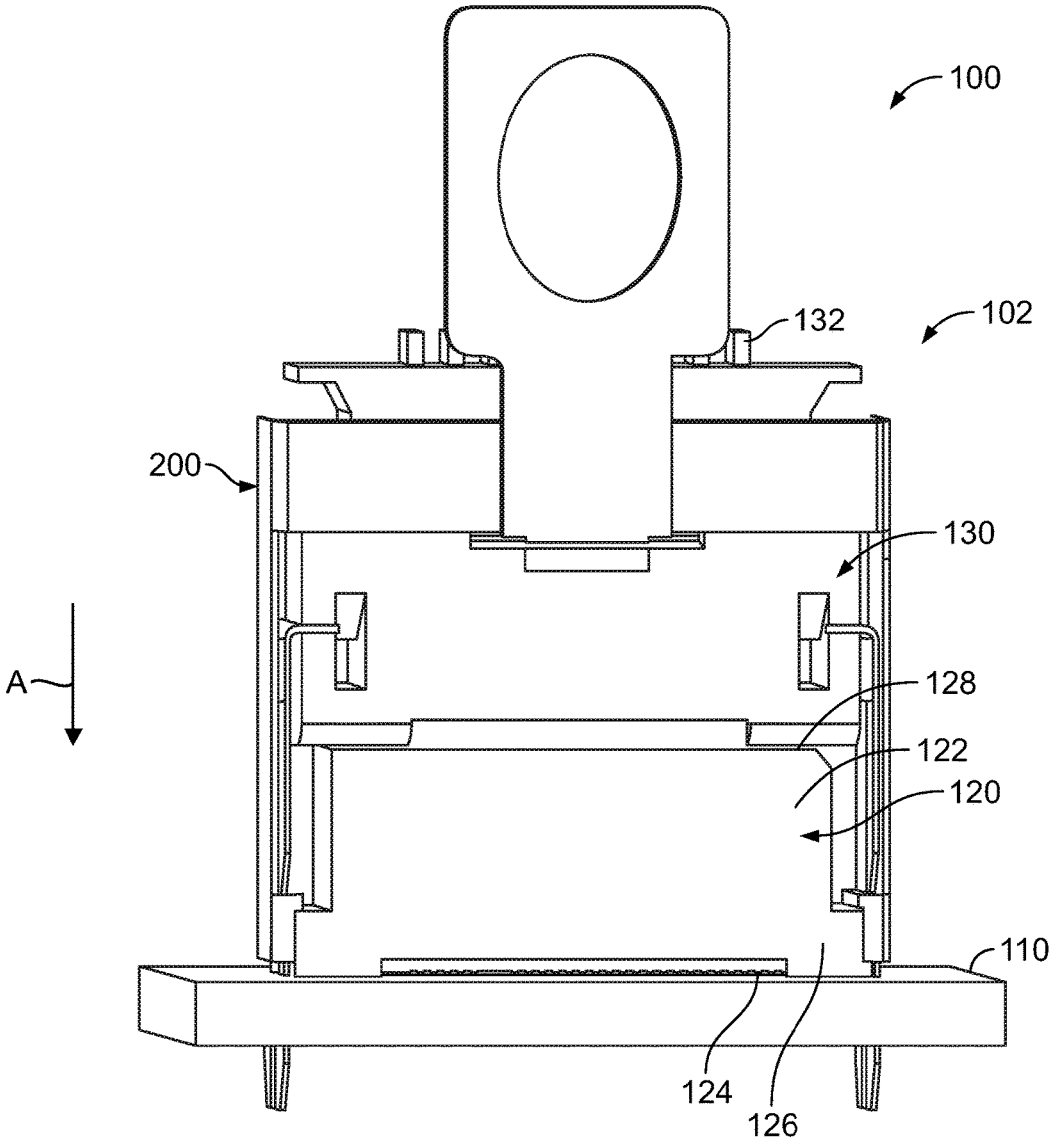
FIG. 1 is a perspective view of an electrical system having a card edge connector assembly in accordance with an exemplary embodiment.

FIG. 1 is a perspective view of an electrical system 100 having a card edge connector assembly 102 in accordance with an exemplary embodiment showing the card edge connector assembly 102 in a mated position. The card edge connector assembly 102 is mounted to a host circuit board 110. In the illustrated embodiment, the card edge connector assembly 102 is a vertical card edge connector assembly where the components are oriented and mated generally vertically or perpendicular to the host circuit board 110. However, in other various embodiments, the electrical system 100 may have components in different orientations, such as at a right angle orientation. In the illustrated embodiment, the card edge connector assembly 102 is a cabled card edge connector assembly; however, other types of card edge connector assemblies may be utilized in alternative embodiments, such as a non-cabled card edge connector assembly utilizing a circuit card rather than a cable pluggable module.

The card edge connector assembly 102 includes a card edge connector 120 and a pluggable module 130. The card edge connector 120 includes a housing 122 holding contacts 124. The housing 122 has a base 126 configured to be mounted to the host circuit board 110, such as using fasteners, solder clips or other mounting elements. The contacts 124 are terminated to the host circuit board 110, such as by soldering the contacts 124 to the host circuit board 110. The card edge connector 120 has a mating end 128 configured to receive the pluggable module 130. The mating end 128 is provided at a top of the card edge connector 120 to receive the pluggable module 130 in a generally vertical mating direction, such as a mating direction perpendicular to the host circuit board 110 represented by arrow A.

The card edge connector assembly 102 includes a support member for the pluggable module 130, such as support hardware 200 configured to be mounted directly to the host circuit board 110 adjacent the card edge connector 120 to support the pluggable module 130. The support hardware 200 may alleviate stress or strain on the card edge connector 120 from the pluggable module 130. In an exemplary embodiment, the support hardware 200 is configured to be latchably secured to the host circuit board 110 for latchably securing the pluggable module 130 to the host circuit board 110. The support hardware 200 is configured to be released to remove the pluggable module 130 from the card edge connector 120. The support hardware 200 is removable from the host circuit board 110 and the card edge connector 120 with the pluggable module 130.

In an exemplary embodiment, the pluggable module 130 is a cable pluggable module having cables 132 extending therefrom. The support hardware 200 may alleviate stress or strain on the card edge connector 120 from the pluggable module 130, such as from pulling forces on the cables 132. The cables 132 exit the pluggable module 130 generally opposite the card edge connector 120, such as vertically from the top thereof; however, the cables 132 may exit from other portions of the pluggable module 130 or in other directions, such as horizontally.

Figure 2:
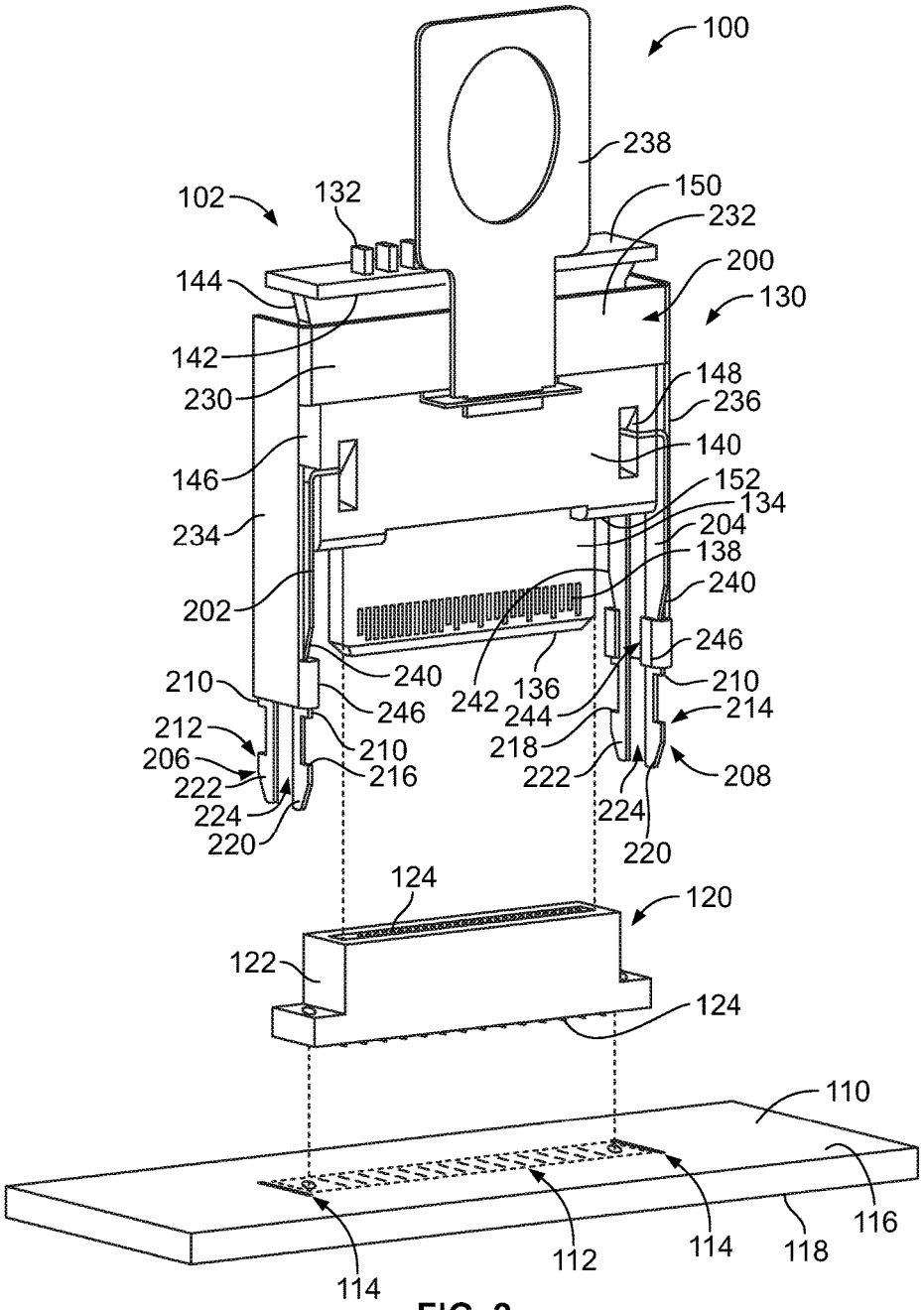
FIG. 2 is an exploded view of the card edge connector assembly in accordance with an exemplary embodiment.
Figure 3:
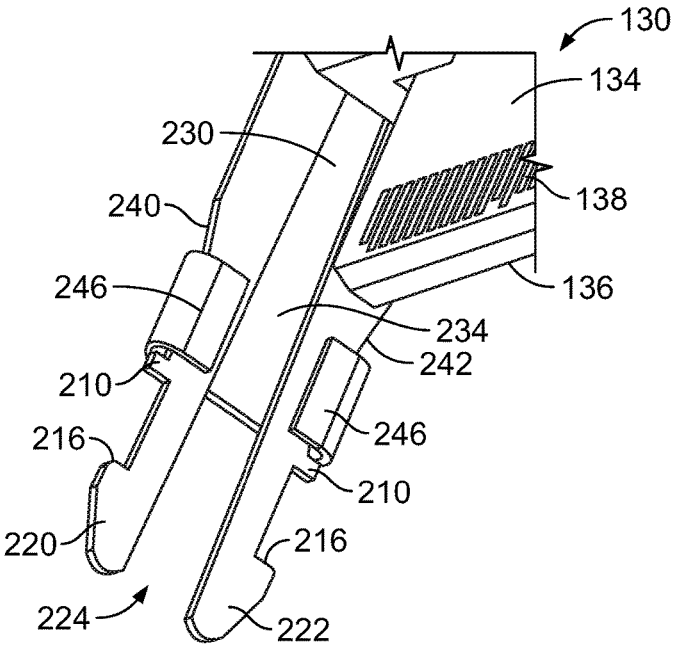
FIG. 3 is an enlarged view of a portion of the card edge connector assembly.

FIG. 2 is an exploded view of the card edge connector assembly 102 showing the card edge connector 120, the support hardware 200 and the pluggable module 130 in accordance with an exemplary embodiment. FIG. 3 is an enlarged view of a portion of the card edge connector assembly 102. The card edge connector 120 is configured to be coupled to a mounting area 112 of the host circuit board 110. The support hardware 200 is configured to be mounted to the host circuit board 110 proximate to the mounting area 112 area for example, in an exemplary embodiment, the host circuit board 110 includes slots 114 on opposite sides of the mounting area 112. The support hardware 200 is received in the slots 114 to secure the card edge connector assembly 102 to the host circuit board 110.

The pluggable module 130 includes the cables 132 to electrically connect the pluggable module 130 to another component remote from the pluggable module 130 within the electrical system 100. The pluggable module 130 interfaces with the cables 132 and with the corresponding card edge connector 120 to electrically connect the card edge connector 120 with another component, such as another connector, through the cables 132.

In an exemplary embodiment, the pluggable module 130 includes a paddle card 134 having a card edge 136 configured to be received in the card edge connector 120. The paddle card 134 includes a plurality of contact pads 138 at the card edge 136 for connection with the contacts 124 of the card edge connector 120. The cables 132 may be terminated to the paddle card 134, such as being soldered to traces of the paddle card 134. The paddle card 134 includes various circuits transmitting data and/or power between the contact pads 138 and the cables 132. In various embodiments, the pluggable module 130 does not include separate electrical components (for example, memory, processors, and the like) on the paddle card 134, but rather is electrically connected to corresponding electrical components via the cables 132. In other various embodiments, the paddle card 134 may include electrical components thereon.

In an exemplary embodiment, the pluggable module 130 includes a pluggable body 140 configured to hold the paddle card 134 and/or the cables 132. For example, the pluggable body 140 may be an overmolded body molded around the paddle card 134 and ends of the cables 132. In other various embodiments, the pluggable body 140 is a housing, premolded and receiving the paddle card 134 and the ends of the cables 132. Optionally, the housing may be a multi-piece housing, such as two pieces coupled together around the paddle card 134 and the cables 132. The pluggable body 140 provides strain relief for the cables 132. In an exemplary embodiment, the card edge 136 of the paddle card 134 is exposed beyond an end of the pluggable body 140.

In an exemplary embodiment, the pluggable body 140 includes a first side 142 and a second side 144 extending between a first end 146 and a second end 148. The pluggable body 140 extends between a cable end 150 and a mating end 152 opposite the cable end 150. The cables 132 exit the pluggable body 140 at the cable end 150.

The support hardware 200 is coupled to the pluggable body 140. The support hardware 200 is used to secure the pluggable module 130 to the host circuit board 110. In an exemplary embodiment, the support hardware 200 is latchably coupled to the host circuit board 110. For example, the support hardware 200 is received in the slots 114 and secured to the host circuit board 110 to support the pluggable body 140. Having the pluggable body 140 supported by the support hardware 200 on the host circuit board 110 alleviates at least some of the forces on the card edge connector 120.

The support hardware 200 includes a first mounting leg 202 coupled to and extending from the first end 146 of the pluggable body 140 and a second mounting leg 204 coupled to and extending from the second end 148 of the pluggable body 140. The first and second mounting legs 202, 204 are provided on opposite ends of the paddle card 134 and are configured to extend along opposite ends of the housing 122 of the card edge connector 120. The support hardware 200 includes a first mounting foot 206 at the distal end of the first mounting leg 202 and a second mounting foot 208 at the distal end of the second mounting leg 204. The first and second mounting feet 206, 208 engage the host circuit board 110. The first and second mounting feet 206, 208 support the support hardware 200. In an exemplary embodiment, each mounting foot 206, 208 includes one or more stop tabs 210 for supporting the support hardware 200. The stop tabs 210 are configured to engage in an upper surface 116 of the host circuit board 110.

In an exemplary embodiment, portions of the mounting feet 206, 208 are configured to extend through the slots 114 and the host circuit board 110. Optionally, the distal ends of the mounting feet 206, 208 may be tapered to guide loading of the mounting feet 206, 208 into the slots 114.

In an exemplary embodiment, the first and second mounting legs 202, 204 include first and second latches 212, 214.

Optionally, the first and second latches 212, 214 may be defined by the first and second feet 206, 208. In other embodiments, the first and second latches 212, 214 may extend from the first and second feet 206, 208. The first and second latches 212, 214 are configured to engage and latchably secure the first and second mounting legs 202, 204 to the host circuit board 110. For example, the first and second latches 212, 214 include latching surfaces 216, 218 configured to engage a lower surface 118 of the host circuit board 110. The latching surfaces 216, 218 are upward facing surfaces facing the pluggable body 140. Optionally, the stop tabs 210 and the latching surfaces 216, 218 oppose each other and define a space configured to receive the host circuit board 110. The space may have a height approximately equal to a thickness of the host circuit board 110 such that the host circuit board 110 is captured between the stop tabs 210 and the latching surfaces 216, 218.

In an exemplary embodiment, the latches 212, 214 are releasable to release the support hardware 200 from the host circuit board 110. For example, each of the latches 212, 214 may include a first latching beam 220 and a second latching beam 222 movable relative to each other to release the corresponding latches 212, 214. Optionally, either or both of the latching beams 220, 222 may be movable. In the illustrated embodiment, each latching beam 220, 222 includes a corresponding stop tab 210 and a corresponding latching surface 216 or 218 extending therefrom. A channel 224 is defined between the latching beams 220, 222 to allow the latching beams 220, 222 to be deflected toward each other to release the latches 212, 214. Other types of latches 212, 214 may be provided in alternative embodiments, such as single arm deflectable latches, collet-type latches, threaded fasteners, jack screws, or other types of latches.

In an exemplary embodiment, the support hardware 200 includes an actuator 230 operated to release the latches 212, 214. In the illustrated embodiment, the actuator 230 includes a crossbeam 232 extending between a first slide 234 and a second slide 236. The actuator 230 includes a handle 238, such as a pull tab for a tether, coupled to the crossbeam 232 to actuate or move the actuator 230. For example, the handle 238 may be pulled upward to move the actuator 230. The first and second slides 234, 236 move with the crossbeam 232 to release the latches 212, 214. The first slide 234 extends along and operably engages the first mounting leg 202 to release the first latch 212. The second slide 236 extends along and operably engages the second mounting leg 204 to release the second latch 214.

With reference to FIG. 3, in an exemplary embodiment, the first slide 234 is slidable along the first mounting leg 202 to engage the corresponding latching beams 220, 222. When the actuator 230 is actuated, the first slide 234 moves upward to engage the latch 212 and force the latching beams 220, 222 to move closer to each other. For example, the latching beams 220, 222 include ramps 240, 242 above a seat 244. The first slide 234 includes arms 246 configured to engage the ramps 240, 242 when the first slide 234 is moved upward. In the illustrated embodiment, the arms 246 wrap around the first mounting leg 202. In the normal or resting position, the arms 246 are located at the seat 244 below the ramps 240, 242 and above the stop tabs 210, which may serve to support the first slide 234 in the normal or resting position. In the actuated position, the arms 246 are pulled upward to engage the ramps 240, 242.

In an exemplary embodiment, the second slide 236 is slidable along the second mounting leg 204 to engage the corresponding latching beams 220, 222. When the actuator 230 is actuated, the second slide 236 moves upward to engage the latch 214 and force the latching beams 220, 222 to move closer to each other. The second slide 236 includes the arms 246 configured to engage the ramps 240, 242 on the latching beams 220, 222. Other types of latches and release mechanisms may be used in alternative embodiments.

Figure 4:
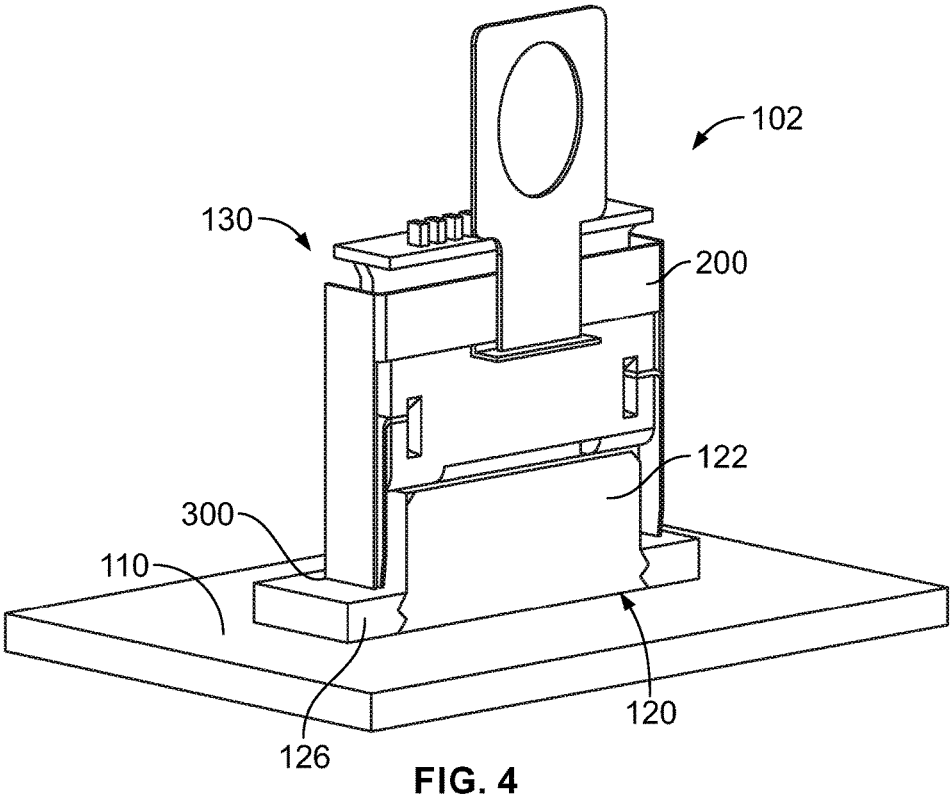
FIG. 4 is a perspective view of the card edge connector assembly in accordance with an exemplary embodiment.

FIG. 4 is a perspective view of the card edge connector assembly 102 in accordance with an exemplary embodiment. In the illustrated embodiment, the support hardware 200 is received in the housing 122 of the card edge connector 120. For example, the support hardware 200 is received in slots 300 in the base 126 of the housing 122. In an exemplary embodiment, the support hardware 200 is configured to engage the host circuit board 110 below the housing 122 to support the pluggable module 130. For example, the support hardware 200 may be received in corresponding slots in the host circuit board 110 below the slots 300 in the base 126 of the housing 122. The support hardware 200 may be latchably secured to the host circuit board 110.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A card edge connector assembly comprising:

a pluggable module having a paddle card at a mating end of the pluggable module, the paddle card having a card edge including contact pads, the pluggable module having a first side and a second side extending between a first end and a second end;

a card edge connector having a housing defining a card slot receiving the card edge of the paddle card, the housing having a base configured to be mounted to a host circuit board, the housing holding contacts in the card slot to electrically connect to corresponding contact pads of the paddle card, the contacts being configured to be electrically connected to the host circuit board; and support hardware coupled to the pluggable module, the support hardware having a first mounting leg extending from the first end of the pluggable module and a second mounting leg extending from the second end of the pluggable module, the first mounting leg having a first mounting foot configured to be mounted to the host circuit board, the second mounting leg having a second mounting foot configured to be mounted to the host circuit board to support the pluggable module on the host circuit board independent of the card edge connector the first mounting leg including a first stop tab extending therefrom configured to seat against the host circuit board and the second mounting leg including a second stop tab extending therefrom configured to seat against the host circuit board.

2. The card edge connector assembly of claim 1, wherein the support hardware is removable from the card edge connector with the pluggable module.

3. The card edge connector assembly of claim 1, wherein the first mounting foot is releasably coupled to the host circuit board and the second mounting foot is releasably coupled to the host circuit board.

4. The card edge connector assembly of claim 1, wherein the first mounting leg is coupled to the first end of the pluggable module and the second mounting leg is coupled to the second end of the pluggable module.

5. The card edge connector assembly of claim 1, wherein the pluggable module includes a pluggable body holding the panel card, the support hardware being coupled to the pluggable body.

6. The card edge connector assembly of claim 1, wherein the pluggable module includes cables terminated to the paddle card and electrically coupled to corresponding contact pads.

7. The card edge connector assembly of claim 1, wherein the first mounting foot includes a first latch latchably coupled to the host circuit board and the second mounting foot includes a second latch latchably coupled to the host circuit board.

8. The card edge connector assembly of claim 7, wherein the first latch includes a latching surface configured to engage a lower surface of the host circuit board.

9. The card edge connector assembly of claim 7, further comprising an actuator coupled to the first latch in the second latch, the actuator releasing the first and second latches to release the support hardware from the host circuit board to remove the pluggable module from the card edge connector.

10. The card edge connector assembly of claim 9, wherein the actuator slides along the first latch to release the first latch.

11. The card edge connector assembly of claim 7, wherein the first latch includes a first latching beam and a second latching beam movable relative to each other to release the first latch.

12. The card edge connector assembly of claim 1, wherein the first mounting leg extends through the base of the housing of the card edge connector to engage the host circuit board.

13. A card edge connector assembly comprising:

a pluggable module having a paddle card at a mating end of the pluggable module, the paddle card having a card edge including contact pads, the pluggable module having a first side and a second side extending between a first end and a second end;

a card edge connector having a housing defining a card slot receiving the card edge of the paddle card, the housing having a base configured to be mounted to a host circuit board, the housing holding contacts in the card slot to electrically connect to corresponding contact pads of the paddle card, the contacts being configured to be electrically connected to the host circuit board, the housing having a first side and a second side extending between a first end and a second end; and support hardware coupled to the pluggable module, the support hardware having a first mounting leg extending from the first end of the pluggable module and a second mounting leg extending from the second end of the pluggable module, the first mounting leg having a first latch at a distal end of the first mounting leg configured to be latchably secured to the host circuit board, the second mounting leg having a second latch at a distal end of the second mounting leg configured to be latchably secured to the host circuit board to latchably secure the pluggable module to the host circuit board independent of the card edge connector, the support hardware having an actuator to release at least one of the first latch and the second latch to release the support hardware from the host circuit board to remove the pluggable module from the card edge connector, the first latch including a latching surface configured to engage a lower surface of the host circuit board.

14. The card edge connector assembly of claim 13, wherein the support hardware is removable from the card edge connector with the pluggable module.

15. The card edge connector assembly of claim 13, wherein the actuator slides along the first latch to release the first latch.

16. The card edge connector assembly of claim 13, wherein the first latch includes a first latching beam and a second latching beam movable relative to each other to release the first latch.

17. The card edge connector assembly of claim 13, wherein the first latch extends through the base of the housing of the card edge connector to engage the host circuit board.

18. A card edge connector assembly comprising:

a host circuit board having a mounting area having a plurality of contact pads, the host circuit board having a first slot proximate to the mounting area and a second slot proximate to the mounting area;

a card edge connector having a housing defining a card slot, the housing has a base mounted to the mounting area of the host circuit board, the housing holds contacts in the card slot, the contacts being electrically connected to corresponding contact pads on the host circuit board, the housing having a first side and a second side extending between a first end and a second end;

a pluggable module having a paddle card at a mating end of the pluggable module, the paddle card having a card edge including contact pads, the paddle card being received in the card slot to electrically connect the contact pads of the paddle card to the contacts of the card edge connector, the pluggable module having a first side and a second side extending between a first end and a second end; and support hardware coupled to the pluggable module, the support hardware having a first mounting leg extending from the first end of the pluggable module and a second mounting leg extending from the second end of the pluggable module, the first mounting leg having a first mounting foot received in the first slot, the second mounting leg having a second mounting foot received in the second slot, the first mounting leg including a first stop tab extending therefrom configured to seat against the host circuit board and the second mounting leg including a second stop tab extending therefrom configured to seat against the host circuit board, the support hardware being mounted to the host circuit board to support the pluggable module on the host circuit board independent of the card edge connector.

* * * * *